US009222260B1

(12) United States Patent
Hao

(10) Patent No.: US 9,222,260 B1
(45) Date of Patent: Dec. 29, 2015

(54) LIGHTWEIGHT MULTI-LAYER ARCH-STRUCTURED ARMOR (LMAR)

(76) Inventor: Su Hao, Irvine, CA (US)

( * ) Notice: Subject to any disclaimer, the term of this patent is extended or adjusted under 35 U.S.C. 154(b) by 217 days.

(21) Appl. No.: 12/760,536

(22) Filed: Apr. 14, 2010

Related U.S. Application Data

(60) Provisional application No. 61/202,842, filed on Apr. 10, 2009.

(51) Int. Cl.
*E04C 2/32* (2006.01)

(52) U.S. Cl.
CPC ..... *E04C 2/32* (2013.01)

(58) Field of Classification Search
CPC ..... E04C 2/32; E04C 2/3405
USPC ..... 89/36.01, 36.02, 36.04, 36.12, 36.05; 114/9–14, 240 D; 52/783.11, 783.18, 52/783.19, 674, 798.1, 1
See application file for complete search history.

(56) References Cited

U.S. PATENT DOCUMENTS 2,316,055 A * 4/1943 Davey ..... F41H 5/08 2/2.5
3,431,818 A * 3/1969 King ..... 89/36.02
3,519,529 A * 7/1970 Cook ..... 428/142
3,950,910 A * 4/1976 Pobanz ..... E04C 2/322 411/176
3,962,976 A 6/1976 Kelsey
4,133,158 A * 1/1979 Ting ..... E04B 7/107 52/478
4,221,413 A * 9/1980 Bonnetain ..... 293/122
4,617,072 A * 10/1986 Merz ..... 156/89.25
4,704,754 A 11/1987 Bonasso
5,196,252 A 3/1993 Harpell
5,200,256 A 4/1993 Dunbar
5,349,893 A 9/1994 Dunn
5,376,426 A 12/1994 Harpell et al.
5,679,467 A 10/1997 Priluck
5,686,689 A 11/1997 Snedeker et al.
6,112,635 A 9/2000 Cohen
6,568,310 B2 5/2003 Morgan
6,599,645 B2 * 7/2003 Wittebrood ..... B23K 35/0238 228/181
6,635,357 B2 10/2003 Moxson et al.
6,644,535 B2 * 11/2003 Wallach et al. ..... 228/173.5
6,826,996 B2 12/2004 Strait
6,895,851 B1 5/2005 Adams et al.
6,920,817 B2 7/2005 Ravid et al.
7,037,865 B1 5/2006 Kimberly (Continued)

FOREIGN PATENT DOCUMENTS

DE 102008024486 A1 11/2009

*Primary Examiner* — Reginald Tillman, Jr.
(74) *Attorney, Agent, or Firm* — Troutman Sanders LLP

(57) ABSTRACT

The present invention discloses a class of arch-structured, multi-layer, lightweight composites with high capacity to absorb and disperse single or multiple incoming objects with associated energy flux that directly strikes onto one side of the composite, so as minimize the impact and possible damage to the objects behind another side of the composite, wherein the upcoming moving objects can be projectiles, or an upcoming shock wave front produced by blasts, or the impact during a collision, for examples, a crush-landing of an air-vehicle and the impact of heavy truck's wheel to a bridge's deck. This class of composite is termed "Lightweight Multi-layer Arch-structured Composite", in short, LMAR, which implements the art of arch bridges' design into the art of mesoscopic structural design of the composites, allowing optimized combination in geometries and materials to gain desired physical properties and to manufacture with affordable cost.

21 Claims, 5 Drawing Sheets

(56) References Cited

U.S. PATENT DOCUMENTS

| | | | |
|---|---|---|---|
| 7,077,048 | B1 | 7/2006 | Anderson, Jr. et al. |
| 7,100,490 | B2 | 9/2006 | Muller |
| 7,288,326 | B2 | 10/2007 | Elzey et al. |
| 7,424,967 | B2 | 9/2008 | Ervin et al. |
| 7,478,817 | B1 | 1/2009 | Carrier et al. |
| 7,523,693 | B1 | 4/2009 | Engelhart |
| 7,598,652 | B2 | 10/2009 | Kornbluh et al. |
| 7,666,258 | B2 | 2/2010 | Guevara et al. |
| 2005/0146402 | A1 | 7/2005 | Sarabandi et al. |
| 2005/0193480 | A1 | 9/2005 | Carlson |

* cited by examiner

LIGHTWEIGHT MULTI-LAYER ARCH-STRUCTURED ARMOR (LMAR)

REFERENCES CITED

U.S. Patent Document
U.S. Pat. No. 3,431,818 3/1969 King
U.S. Pat. No. 3,962,976 6/1976 Kelsey
U.S. Pat. No. 4,704,754 10/1987 Bonasso
U.S. Pat. No. 5,196,252 3/1993 Harpell
U.S. Pat. No. 5,200,256 4/1993 Dunbar
U.S. Pat. No. 5,349,893 9/1994 Dunn
U.S. Pat. No. 5,376,426 12/1994 Harpell
U.S. Pat. No. 5,679,467 10/1997 Priluck
U.S. Pat. No. 5,686,689 11/1997 Snedeker et al.
U.S. Pat. No. 6,112,635 9/2000 Cohen
U.S. Pat. No. 6,568,310 B2 5/2003 Morgan
U.S. Pat. No. 6,635,357 B2 10/2003 Moxson et al.
U.S. Pat. No. 6,826,996 B2 12/2004 Strait
U.S. Pat. No. 6,895,851 B1 5/2005 Adams et al.
U.S. Pat. No. 6,920,817 B2 7/2005 Ravid et al.
2005/0146402 A1 7/2005 Sarabandi et al.
2005/0193480 A1 8/2005 Carlson
U.S. Pat. No. 7,037,865 B1 5/2006 Kimberly
U.S. Pat. No. 7,077,048 B1 7/2006 Anderson et al.
U.S. Pat. No. 7,100,490 9/2006 Muller
U.S. Pat. No. 7,288,326 B2 10/2007 Elzey et al.
2008/0075930 3/2008 Kornbluh et al.
U.S. Pat. No. 7,401,643 B2 7/2008 Queheillalt et al.
U.S. Pat. No. 7,424,967 B2 9/2008 Ervin et al.
U.S. Pat. No. 7,478,817 B1 1/2009 Brian et al.
U.S. Pat. No. 7,523,693 B1 4/2009 Engelhart
U.S. Pat. No. 7,666,258 B2 2/2010 Guevara et al.

OTHER REFERENCES

[1] "Casualty Summary by Reason Code: Oct. 12, 2001-Apr. 3, 2010", DoD Personal & Procurement Reports and Data Files, 2010.

[2] Gooch, W., Burkins, M., MacKenzie, D and Vodenicharov, S. "Ballistic Analysis of Bulgarian Dual Hard Steel Plate," in the Proceedings of the 22nd International Symposium on Ballistics, Vancouver, BC, Canada, 14-15 Nov. 2005.

[3] Hansen A. C., and Garnich, M. R., 1995, Composites Engineering, 5(9):1091-1103.

[4] H. N. G. Wadley, "Multifunctional Periodic Cellular Metals", Phil. Trans. R. Soc. A, 364, 31-68 (2005).

[5] Nemat-Nasser, S. and S. Sarva, "Micro-mechanisms of Compression Failure," PACRIM IV, Proceedings, Ceramic Armor by Design, Ceramic Transactions, Vol. 134 (2002) 403-420.

[6] K. Ravi-Chandar and W. G. Knauss (1984) "An Experimental Investigation Into Dynamic Fracture-IV. On the Interaction of Stress Waves with Propagating Cracks," *International Journal of Fracture* 26 189-200.

[7] Hao, S., "Report I: A Preliminary Analysis of I-35W Collapse", <http://www.suhao-acii.com/files/Report1.pdf>, (Submitted to National Transportation Safety Board at Sep. 22, 2007).

[8] Hao, S., "A Note of the I-35W Bridge Collapse", ASCE J. of Bridge Engineering, September, 2010.

[9] Hao, S., W. K. Liu. "Moving particle finite element with global super-convergence", Computer Method in Applied Mechanics and Engineering, Volume 196, Pages 6059-6072, 2006

[10] Hao, S., B. Moran, W. K. Liu, and G. B. Olson, "A Hierarchical Multi-Physics Constitutive Model for Steels Design", J. Computer-Aided Materials Design, Volume 10, Number 2, Pages 99-142, 2003.

[11] Hao, S., and W. Brocks, "The Gurson-Tvergaard-Needleman-Model for Rate and Temperature-Dependent Materials", Computational Mechanics, Volume 20, Page 34, 1997.

[12] K. Nahshon, M. G. Pontin, A. G. Evans, J. W. Hutchinson, and F. W. Zok, "Dynamic Rupture of Steel Plates", Journal of Mechanics of Materials and Structures, 2, 2049-2066 (2007).

[13] Grujicic, M., Glomski, P. S., Arakere, T. He, G., Bell, W. C. and B. A. Cheeseman, Journal of Materials Engineering and Performance, published online, Feb. 27, 2009.

[14] Hansen A. C., and Garnich, M. R., 1995, Composites Engineering, 5(9):1091-1103.

[15] Mayes, J. S., and Hansen, A. C., 2004, Composites Science and Technology, 64(3-4).

[16] Robbins, D. H., Jr., Reddy, J. N., and Rostam-Abadi, F., 2005, International Journal of Mechanics and Materials in Design, 2:165-182.

DESCRIPTION

1. Field of Invention

The present invention is based on a novel concept and associated designs for a class of structural composites that are characterized by the embodiment of arch-shaped mesoscopic structural elements. Its primary function is to protect objects in the gap between this class of composite sheets or behind such a composite sheet. For this purpose, the novel concept enables the design of arches-and-plates overlays that allows optimized combination in geometry's detailing and materials' selection to gain reduced weight and high load capacity while provides additional stiffness to reinforce global structure that is partially or entirely made of the composite through. Thus, this class of composites can be used as lightweight armor, protective deck, wall, or container, energy absorption and harvesting composite, in civil and military platforms such as Mine Resistance Ambush Protected Vehicles, close-supporting or transportation helicopters, and other air and sea vehicles, or in civilian structures that require light weight and extraordinary capacity of energy absorption when under dynamic loads, for examples, blast-resistance doors and containers, bearings and shear walls in buildings, bridge decks and the protection layers for bridges' piers and pylons.

2. Background of the Invention

Statistic result indicates that more than 60% of our army and marine's casualties in the war on terrorists are caused by explosive devices such as roadside bombs [1]. A tough and urgent task for engineering communities is to develop lightweight and more effective armors to assist the long-term efforts protecting battle field platforms and our soldiers. On the other hand, after Oklahoma federal building explosion and 9.11 attacks, Army Engineering Corp. and American Society of Civil Engineering (ASCE) have been continuously working at new industrial standards and guidelines for robust buildings design, which requires better-protective, light weight, and more affordable blast-resistant materials for both military and civilian applications. Generally speaking, high load capacity, lighter weight, and high capacity in energy absorption are the desirable properties for structural components and structural materials for ever.

A military armor requires the capability sustaining the dynamic loads such as one or multiple blasts or high-speed projectiles' impact and penetrations. These kinds of dynamic loads are characterized by the associated extremely high energy flows that are imposed into localized areas within very short duration. To maximize the absorption of the kinetic energy associated with such an impact while to minimize the damage to an object protected, two common mechanisms are often utilized in armor's design: elastic dispersion and nonlinear dissipation. The former focuses on dispersing impact-induced elastic shocks into large area that smears out concentrated high stress amplitude, so as to reduce localized material's damage; the latter mainly refers to plastic dissipation—through composite structural design and materials' selection to gain the capability to sustain large nonlinear deformation that is able to dissipate impact energy into heat. To this end, the following properties are essential in a common protective composite's design:

(p1) Sufficient strength in its key structural material's element to sustain the peak stress associated with an elastic wave shock at initial stage of an impact;

(p2) Desirable threshold of phase transformation for at least one material component in a protective composite while sufficiently high melting temperature for the major structural elements of the composite, by which the former allows to transfer kinetic energy into heat vibration whereas the latter prevents thermal softening and localized melting that may damage the composite's structural integrity; wherein said phase transformation is a generalized concept that includes, for examples, the transition from linear elastic deformation to nonlinear plastic deformation in any material or the shift in crystal structural sysmetry when a metal is under high stresses or environmental temperature changes.

(p3) capable to disperse concentrated nonlinear deformation into larger area from localized impact zone; in metals, such localized deformation often trigger formation of adiabatic shear bands that lead to subsequent material's failure; delay or ultimately prevent shear band formation is crucial for metal armors' design;

(p4) sufficient stiffness to prevent localized large deformation and to reinforce global structure, so as to minimize the damage to protected objects while assure the global structure of the platform employed the composite intact;

(p5) feasibility and affordability for mass productions.

By reviewing the historic literatures regarding the developments of military vehicles' armors, it can be noticed that conventional single-layered armor systems mainly relies on materials' hardness and strength. Reported laboratories observations demonstrate that more effective protection can be achieved when a hard material is affixed to or backed by another material which is less hardness but with strong fracture toughness and higher capacity in energy absorption. Those observations led to new generations of composite armor systems that utilize different materials as counter parts to gain optimized performance. These kinds of composites can be classified into two categories: multi-layer simply-overlaid composite sheets and cellular composites. However, the former, which is also characterized and often referred as "2D composite", has limited capacity of energy absorption because it usually does not provide sufficient space to accommodate large localized nonlinear deformation; this capacity is crucial to disperse impact-induced energy. Recent years, cellular materials, including porous materials and truss-structured composites such as lattice blocks, become new focuses in armors' developments. Instead of flat layers simply overlaying, this class of composites can be viewed as an assembly of mesoscopic structural cells periodically along three orthogonal directions in a composite sheet. Hence, this class of composites is often referred as "3D composites". However, for many "3D composites", advantages in light weight and energy absorption are often compromised by structural brittleness due to lower toughness and enhanced lower stiffness, as well as the affordability for mass productions. Literatures of 3D composites can be found, for examples, in [2-6, 12-16] and in cited patents.

SUMMARY OF THE INVENTION

The object of this invention is to develop a class of structural composites that have combined properties defined from (p1) to (p5) in the previous section "Background of the Invention", so as to achieve combined advantages from aforementioned 2D and 3D composite armors. Wherein a said composite in this class is an engineering system that assembles the cells, for examples, those plotted in FIG. 1, into the composite, by which the embodiment is that an arch-shaped plate B, confined by upper and lower overlaid reinforce plates A and A', forms an arch unit cell that has the structural stability as the art of arch bridge's design but at the mesoscopic scale for a unit structural element in a composite. This arch unit cell has the enhanced flexibility to implant another filling material C into the cavity confined by the arch frame, wherein said material C can be another composite or a single-phase material that may have any desired property rather than to reinforce the arch cell. The implant of a filling material does not compromise the advantages associated with the cellular characters enhanced to the composite. This composite is termed "Lightweight Multi-layer Arch-structured Armor", in short, LMAR. Plotted in FIG. 2 are the schematic view of five major designs of LMAR composites and possible applications.

BRIEF DESCRIPTION OF THE DRAWINGS

FIG. 1(*b*): Similar to FIG. 1(*a*), it is a block of LMAR composite that can be used as an armor sheet to protect upcoming strikes. This block of LMAR has single layer that contains several cells; wherein each cell comprises three kinds of structural elements: (1) the arch-shaped strip plates $B_{X1}$ and $B_{X2}$ align along the same horizontal direction but the convex arch part (towards top) in the plate $B_{X1}$ coincides to the concave arch part of the plate $B_{X2}$ side by side; whereas the arch-shaped strip plates $B_{Y1}$ and $B_{Y2}$ are aligned crossing over the strip plates $B_{X1}$ and $B_{X2}$ with that convex arch in one strip coincides to concave arch in another strip side by side too; the four crossing-over arch-shaped strip plates $B_{X1}$, $B_{X2}$, $B_{Y1}$, $B_{Y2}$ form a net-work lying on a horizontal plane; a LMAR composite cell may compromises one, two, three, or four arch-shaped strip plates selected from $B_{X1}$, $B_{X2}$, $B_{Y1}$, $B_{Y2}$. (2) top reinforce plate A and bottom reinforce plate A'; (3) the "filling composite" C that is implanted into the space confined by the plates A and A'. According to application requirements, the space can be fully or partially filled by material C or remains as empty.

DESCRIPTION AND DISCUSSION OF THE INVENTION

Arch-shaped geometry is a natural structure adopted by biological creatures after millions years evolution, for examples, egg and some insects' shells. It has been utilized for the art of large-scaled civil engineering structures' designs, such as bridges, for tens centuries. From the viewpoint of structural engineering, the unique advantage of an arch is the capability to transfer a localized pressure imposed on its top uniformly into entire structure without localized high peaks of stress or bending moment if the arch has robust supports at its lower ends when the applied loading is not a super-fast moving projectile that is able to penetrate the arch within the time frame before its induced stress wave propagating cross-over the arch structure.

Figure 1:
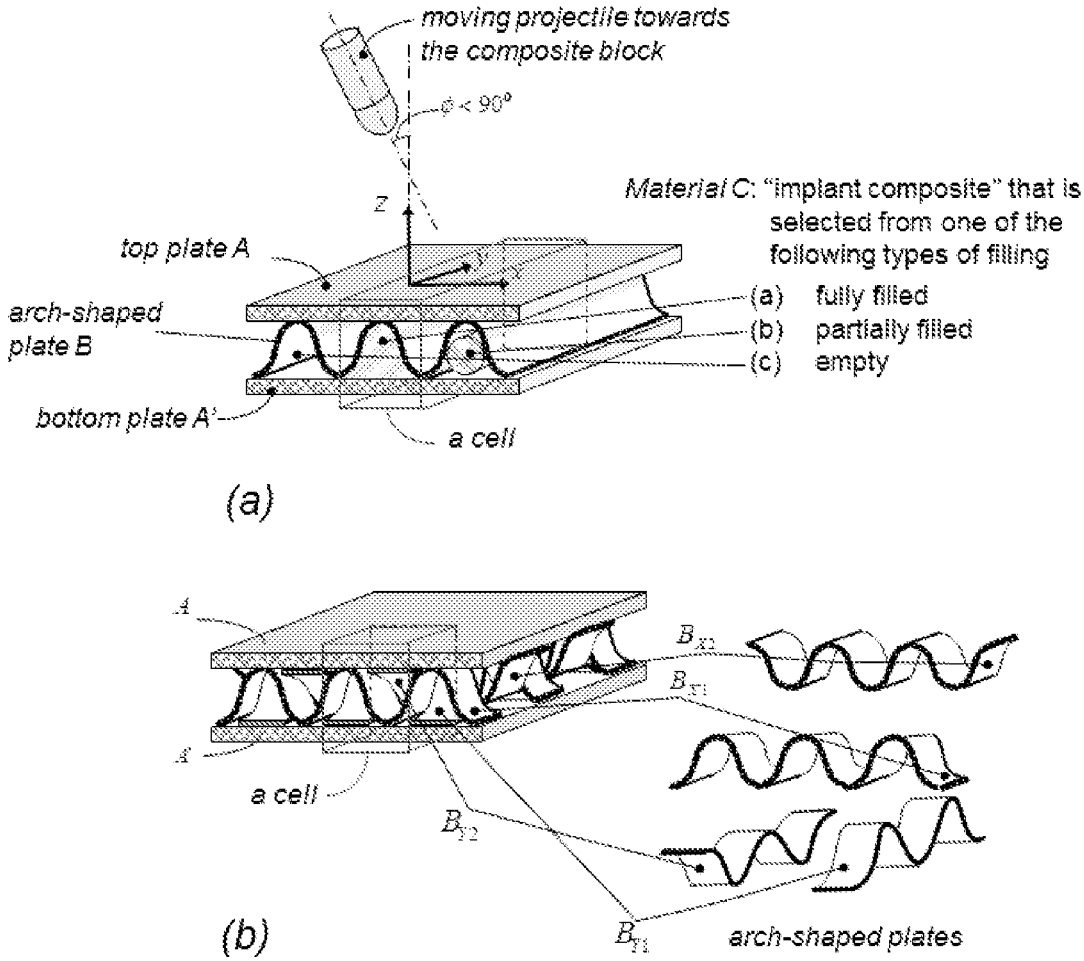
FIG. 1(*a*): A block of LMAR composite that can be used as an armor sheet to protect strikes such as the upcoming high-speed projectile plotted in the figure. This block of LMAR has single layer that contains several cells; wherein each cell comprises three kinds of structural elements: (1) arch-shaped plate B; (2) top reinforce plate A and bottom reinforce plate A'; (3) the "filling composite" C that is implanted into the cavity confined by the arch frame in each arch frame. According to application requirements, the cavity can be fully or partially filled by material C or remains as empty. The arch-shaped plate may include three parts characterized by different geometric parameters: top arch just behind the upper reinforce plate A, the bottom arch attached to bottom plate A', and a straight segment to contact the upper and bottom arches. The top arch and the bottom arch may have different curvatures and size. The straight segment in the arch-shaped plate B is not always necessary and thus may vanish. The upper reinforce plate A is designed to face external impacts that can be an incoming projectile or blast wave front or a quasi-static pressure.

As illustrated by the design drawing in FIG. 1, this invention utilizes an arch-shaped plate B with designed curvature as basic structural member in each cell of the composite, which, in conjunction with the top reinforce plate A, bottom reinforce plate A', and implanted material C, form a basic cell of the invented lightweight, multi-layer, arch-structured armor (LMAR). In such a cell, the top reinforce plate A faces any upcoming energy flux that can be a shock wave front created by nearby blast, a high-speed projectile, energy flux associated with laser beam, or an impact caused a collision. By selecting appropriate top plate's material and its thickness, it enables to reduce the speed of an upcoming projectile down to the range that the underneath plate B is able to maximize the advantages provided by the arch geometry. These advantages include these as following: (i) the capacity to smear out the localized deformation of plate A into larger area; (ii) the arch works as wave-guide to disperse a pressure wave induced by impacts; (iii) the cavities, i.e. the spaces confined by arch-frames, have the functions similar to the cavities in porous material or cellular materials, which is able to accomodate localized large nonlinear deformation while preserving a global structural integrity; (iv) by selecting implant material C according to requirements from each specified applications, the chambers can be filled either by hard material core to reinforce arch frame or by ductile "buffer" material to glue brittle arch and reinforce plates together to prevent fragmentations. (v) the arch frame can be used as carries to hold the material that is solid powder or in liquid state but with other desired non-structural functions; (vi) the arch, top and bottom plates can also be multi-layer simply-overlaid composite plates to maximize the capacity in protection.

For conventions, in this article's text description, claims, and figures the direction perpendicular to plate A is denoted as axis Z. The other two orthogonal directions, which span the plane parallel to the plate A, are denoted as axes X and Y, respectively. Because a LMAR allows multiple arch-layers overlaying, the axis X is chosen to coincide the direction of one arch in a layer, termed "arch-woven direction" for the layer hereafter; so the axis Y is perpendicular to that arch, toward to the direction termed "arch-strip direction" for the layer hereafter. X, Y, and Z form a Cartesian coordinate system originated at the top surface of the plate A. The arch plate B is attached to the plate A at another side, see FIG. 1(*a*). In this Cartesian coordinate system, $\Phi$ denotes the angle between Z axis and the trace of an incoming projectile before it touches the plate A's surface or the progressing direction of an approaching blast wave front. Obviously, $\Phi$ is less than 90 degrees.

EXAMPLES

Figure 2:
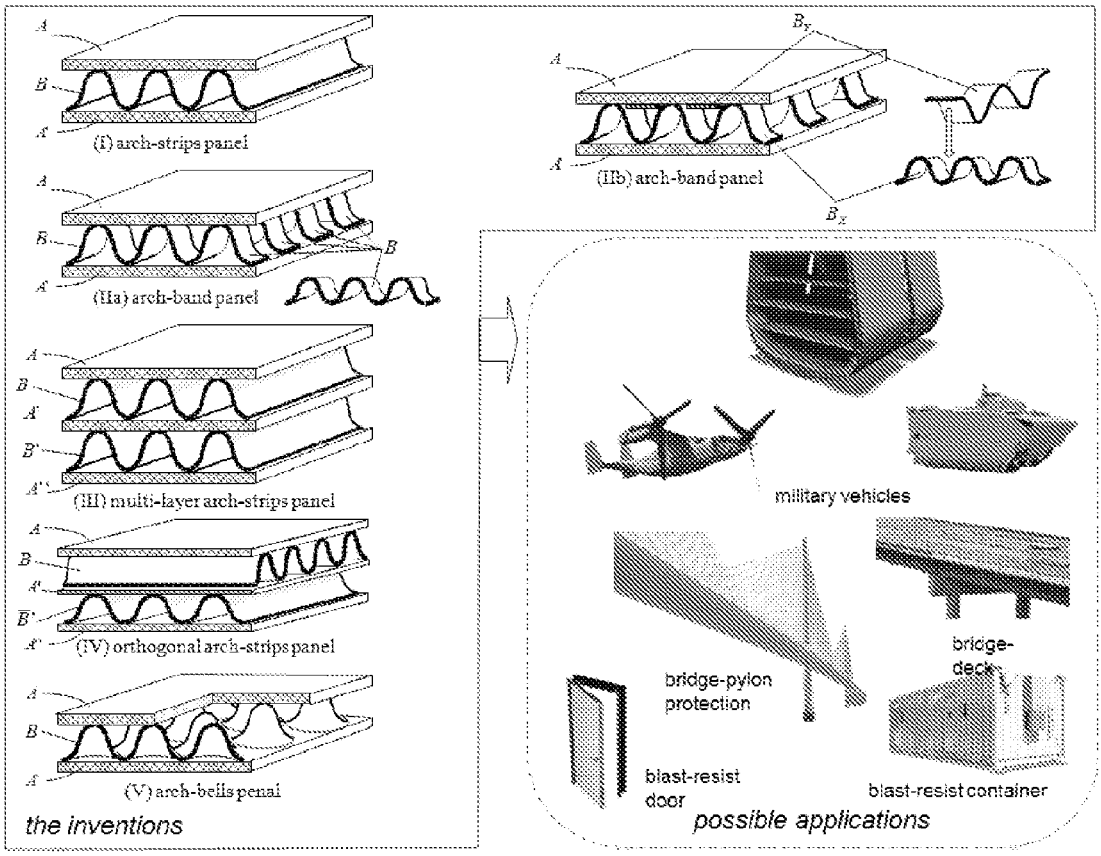
FIG. 2: On left and upper-right are the six design prototypes of LMARs. The images on the middle and lower right illustrate possible applications that require light weight and high blast and penetration resistances, where the images of military vehicles, bridges, blast-resist door and containers are downloaded from internet (www.google.com).

Plotted on the right and upper left of FIG. 2 are five embodiments of the designs of LMARs' cells. A LMAR composite sheet may contain one or multiple overlaid layers; each layer can be formed by one, two, or an array of many periodically laid cells plotted in this figure. The corresponding possible applications are illustrated on the middle and lower right.

On the upper-left corner of FIG. 2 is the type-I LMAR, the basic prototype of this invention. As compared to a monolayer plate with the same areal density, this single arch-layered LMAR has stronger section moment inertia along the arch-strip direction but moderate section inertia along the arch-woven direction. The latter can be reinforced by, for example, additional global structural component such as beam frame that LMAR sheets are attached or fixed upon.

The type-IIa LMAR, just beneath the type-I in the figure, has a set of parallel arch-woven bands. Although it looks like having the similar structure as that in the type-I, these arch-woven bands may work as recoverable "springs" to absorb high impact energy. By contrast, the type-IIb LMAR, plotted right from the type-I in the figure, has two sets of orthogonally overlaid arch-woven bands, which has the similar function as the type-IIa but presents an orthogonal isotropic properties in the sheet plane. The relatively simple geometries in both LMAR IIa and IIb imply the advantage for easy manufacturing. In fact, the FIG. 1*b* is another example of LMAR IIb that has two sets of orthogonally overlaid arch-woven bands and each band has two strip plates with the concave part in one strip coinciding to the convex part in another strip side by side.

The type-III LMAR can be considered as a simple overlay of two type-I sheets but the top arch B and the bottom arch B' share the same reinforce plate A' in between. When the top plate A suffers an impact, the top arch will transfer the corresponding force flow gradually to the middle plate A'; whereas the smooth support from bottom arch B' allowing large deformation of the plate A' without earlier incubation of shear localization that often is the cause of a material's failure. Thus, the arches in these two layers work as "spring-bed" to retard impact shock-induced deformation; as a "buff" in-between is the middle plate A'. Because this LMAR has a sandwich-like structure and the plate A' is the middle layer between two arch sheets that can be designed with relatively higher stiffness, great amount of impact energy can be dissipated by the large deformation of this plate. This mechanism will be discussed again based on the numerical simulation given in FIG. 3.

A schematic view of a cell of the type-IV LMAR is given in FIG. 2, below the type-III. It is also an overlay of two type-I sheets; however, in this case, the arch-woven direction of the top arch intersects that direction in bottom arch with an angle $\theta$. When $\theta=\pi/2$, it forms an orthogonal-anisotropic plate, as illustrated in this figure. When $\theta=0$, it degenerates to the type-III LMAR.

The bottom-left most of FIG. 2 is a schematic view of a cell of type-V LMAR. Instead of arch plate, in this design a group of periodically arranged, bell-shaped plates are inserted into the gap between the top and bottom plates. Such a "bell" can be considered as the trajectory of the section of an arch-shaped beam in a plane after it rotates over 360 degrees, which remains the character of an arch in load-capacity while presents isotropic structural stiffness in the plane of a single-layer LMAR sheet.

Figure 3:
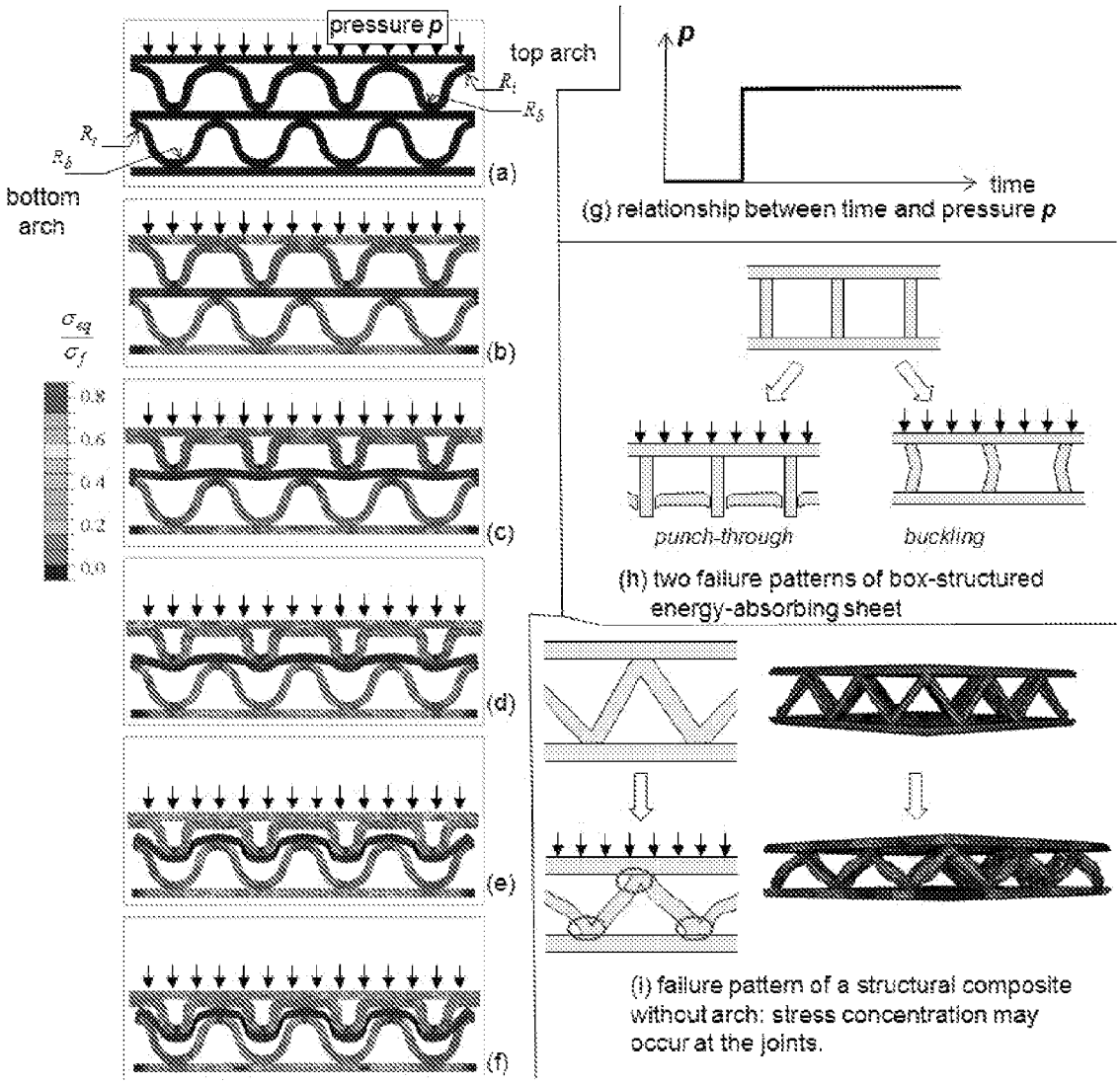
FIG. 3: the snap-shots (a)-(f) show the simulated deformation process and evolution of stress in a type-III LMAR sheet introduced in FIG. 2. This simulation is performed by non-linear finite element by which both material and geometric nonlinearity have been taken into account. In this simulation the composite sheet does not contain implant material C and is under an impact load that is described in (g). The deformation process in (a)-(f) implies that the type-III LMAR can also be considered as a prototype that combines the structural features of the box-type cellular composite illustrated in FIG. 3(*h*) and the V-type structural composites, for example, lattice block, illustrated in FIG. 3(*i*). This is because, at the initial deformation stage, the LMAR is similar to the structure in (i) but an arch is able to smear out the stress concentration at the tip of the V-type plate while the arch also has relative higher instability load. During deformation the top arch in LMAR is distorted towards to a squared shape, as demonstrated in FIGS. 3(*c*) and 3(*d*), which is similar to the box-type cellular composite in FIG. 3(*h*). However, its arch-origin and residual curvature at the corners result in higher resistance against the failure patterns such as "punch-through" or "buckle" illustrated in FIG. 3(*h*).
Figure 4:
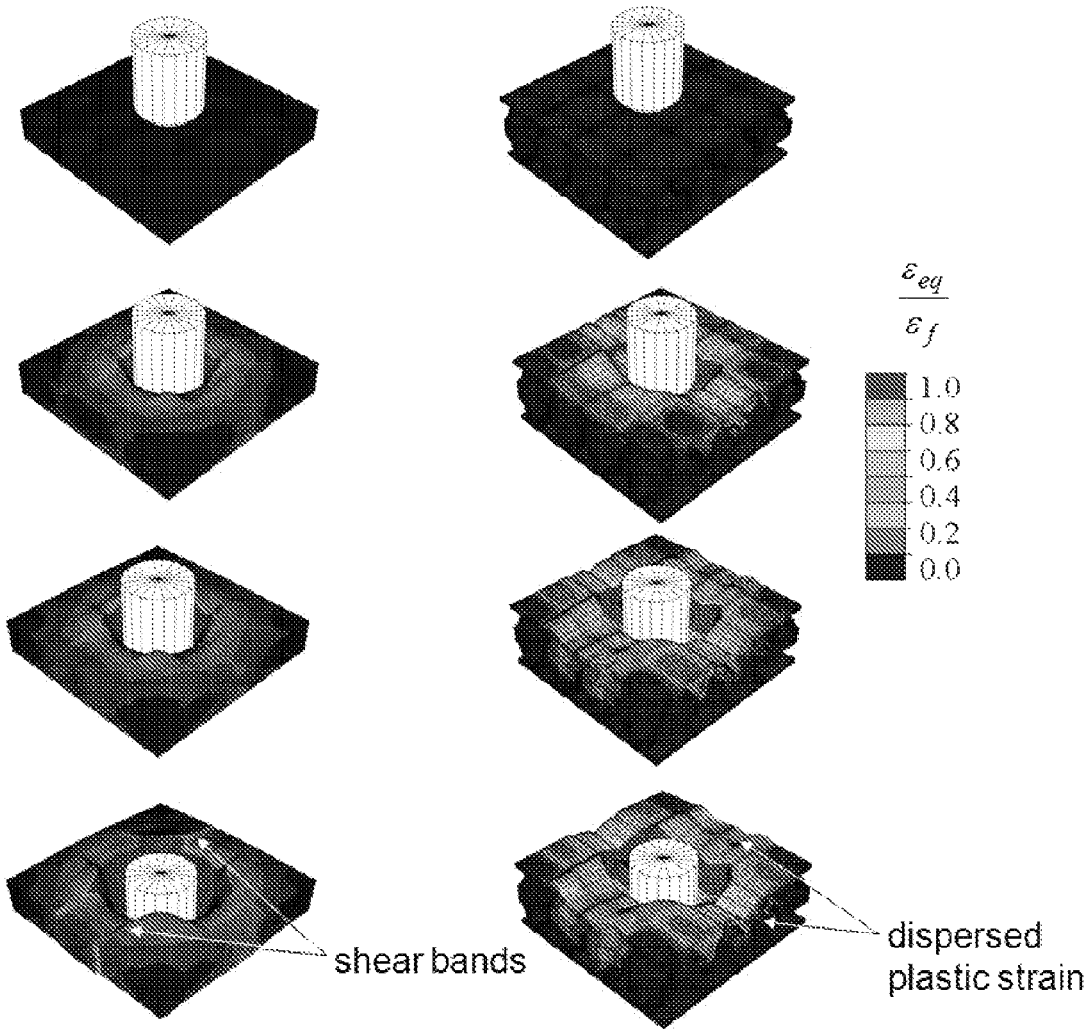
FIG. 4: A side-by-side comparison for the simulated penetration process of a monolayer plate (left) and that of a type-IV LMAR introduced in FIG. 2. This LMAR sheet does not contain implant material C. In the monolayer plate the formation of shear bands can be seen when the projectile is going to penetrate the plate whereas relatively dispersed plastic strain distribution shows off in the LMAR. Formation of shear bonds is a signal for an onset of ductile failure. More results of penetration analysis can be found in the reference [9].

The concept of this invention, illustrated by the examples in FIG. 2, has been verified by the two and three-dimensional numerical computations in FIG. 3 of a type-III LMAR and FIG. 4 of a type-IV LMAR, respectively. The left of FIG. 3, i.e. (a) to (f), is a set of snap-shots for the progressive deformed configurations of a type-III LMAR plate under an impact. This impact can be induced by a blast wave front or the contact during an air-vehicle's crush-landing. The colors in these plots represent the relative amplitude of stress, expressed as the ratio between $\sigma_{eq}$, the equivalent stress (Von Mises stress), and $\sigma_f$, the material's flow stress. The flow stress is defined as the average of the material's yield strength and ultimate strength. The LMAR plate in this computation is made of 70 grad steel (ASTM 709). The impact is imposed by a uniform distributed dynamic pressure p on the upper plate A. The relationship between this pressure and time is illustrated in FIG. 3(*g*). Because a type-III LMAR has two layers, in FIG. 3 the top and bottom arch's curvatures are designed with different values to achieve high energy absorption. As illustrated in FIG. 3(*a*), in the top arch: $R_t<R_b$, whereas $R_t>R_b$ in the bottom arch. On the other hand, the top $R_t$ is greater than that in the bottom layer whereas the $R_b$ in top layer is smaller than its counterpart at the bottom.

According to the computed progressive deformation given in FIGS. 3(*a*)-3(*f*), the scenario of the failure process of this armor sheet can be explained as following: (i) Once the impact is imposed, the force flow led by stress wave front is transferred through the upper arch plate to the middle reinforce plate A' and then to the bottom layer. As compared with a simple-overlaid multi-player sheet, this wavy load path retards strain rate and slows down corresponding deflection. (ii) During this process, the deformation in the top arch plate enlarges $R_t$ while reduces $R_b$, squeezing the arch towards a box-like shape. However, because of the geometric nature of an arch, such a large deformation evolves gradually without sharp shape-change or discontinuity in its geometry. Such a sharp geometric change causes stress concentration that often results in failure of a structure. (iii) When the lower arch in the top layer becomes narrow, the middle plate A' deforms like a metal forming process towards an arch-shaped configuration; the corresponding plastic deformation consumes considerable impact energy. (iv) The deformed middle plate and the lower arch in the top layer fill into the space confined by the arch in the bottom layer; the original two arched-layer sheet becomes a one layer-like LMAR. Obviously, remarkable impact energy has already been dissipated during this process. The remaining one-layer LMAR still has plenty residual strength to protect another impact.

One character of this deformation scenario is that an arch is squeezed gradually towards to a "box" with minimized stationary stress concentration, in other word, without high stress peak localized within small area, which is often the cause of shear band formation and subsequent material's failure. Another feature is that, by selected design of arch geometries, the middle plate A' can be used as a "scarification" layer to absorb great amount energy before the sheet's final failure. By contrast, for a box-shaped cellular-like composite in FIG. 3(*h*), under an impact load stress concentrations often occur at the corners of the "box", resulted in either "punch through" or "buckling", as illustrated in 3(*h*). For another prototype of structural composite that uses zigzag-plates to reinforce but without designed arch, the zigzag corners, which are also the joints between structural components, has high stress concentration under stationary and dynamic loads, as illustrated in FIG. 3(*i*). Thus, this invention, LMAR, can be considered as a further development based on the combined advantage of these 3D composites and simply-overlaid multi-layer plates through the innovative arch design.

FIG. 4 is a side-by-side comparison of simulated penetration process in a monolayer steel plate and that in a type-IV LMAR plate, presented by progressive deformation configurations with enhanced contours of the ratio between equivalent plastic strain and flow strain. Both sheets are made of the 70 grade steel (ASTM A709) with the same density per unit area and the flow strain of the material is taken as the ten folds of value of average yield strain. In these computations the sheets are set as free of boundary condition on their outer surface except the projectile that flies towards them with the initial speed (5 Mhs=1660 Meter/sec.). The results on the left in this figure demonstrate that the failure of the monolayer plate is the subsequence of localized shear bands formation. By contrast, the penetration of the type-IV LMAR plate occurred after the plastic deformation distributed over relatively larger area and dispersed arch-structural collapse, which are the desirable mechanisms for penetration- and blast-resistant structural design.

Figure 5:
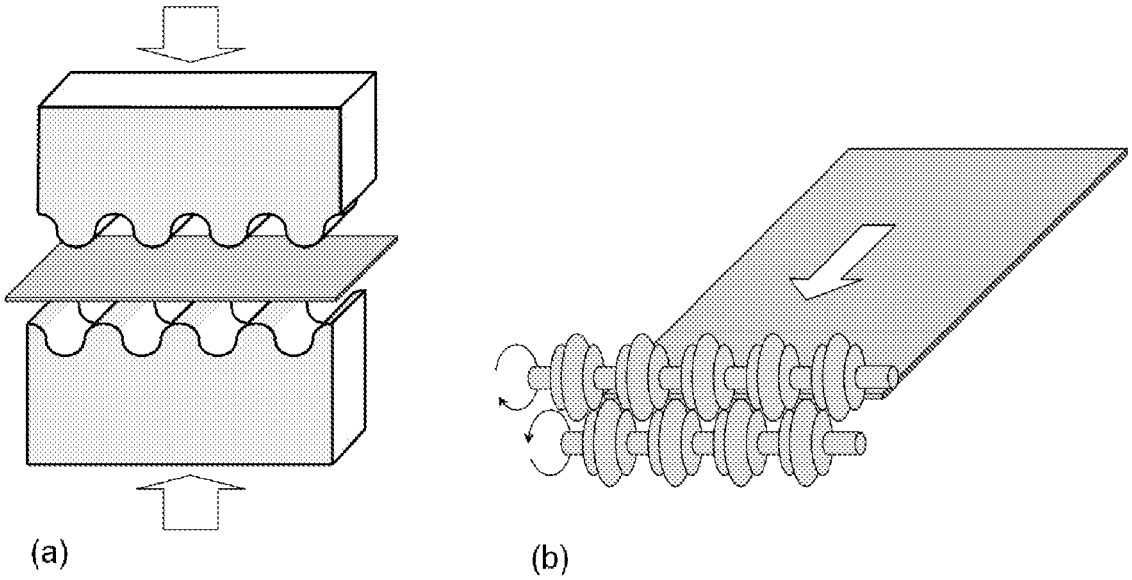
FIG. 5: Two possible procedures to manufacture arch-shaped plate B of LMAR: (a) simple sheet forming; (b) one pass continuing forging-multiple passes may be needed depending upon material and thickness of the sheet.

The simplicity of the LMAR allows mass production with cost-effectiveness. FIG. 5 shows two common forming procedures to manufacture the arched sheet B in FIG. 1.

The development of the ideas and concepts of LMAR can be traced from the applicant's experiences in bridge structural analysis [7,8] and in materials' constitutive behavior investigations and associated new materials' development [10-11]. His research experiences in modeling and simulation of high-speed impact and penetration processes as well as the associated software development [9] enable to apply advanced computational tools for armor composite design to find optimized combinations in materials and structures.

The invention claimed is:

1. A multiple layer composite apparatus configured to protect an object, the multiple layer composite apparatus comprising:

at least one cell configured to redistribute at least one applied load, the at least one cell comprising:

a first planar layer with a first material, wherein the first planar layer is configured to receive the at least one applied load in at least one applied load area;

a second planar layer with a second material and a second fracture toughness, wherein the first material differs from the second material; and at least one structurally robust arched plate operatively connected to and disposed between the first and second planar layers configured to disperse energy created by the at least one applied load;

wherein the at least one arched plate is corrugated and defined by at least one first arch and at least one second arch; and wherein the at least one first arch is operatively connected to and overlaid with the first planar layer and the at least one second arch is operatively connected to and overlaid with the second planar layer so that a contact-induced nonlinear deformation results between the arches and the first and second planar layers upon receipt of the at least one applied load.

2. The apparatus according to claim 1, wherein the at least one structurally robust arched plate is configured to transition from at least one linear deformation to at least one nonlinear deformation.

3. The apparatus according to claim 1, wherein the at least one structurally robust arched plate is configured to sustain a nonlinear deformation and dissipate the energy created by the at least one applied load into heat.

4. The apparatus according to claim 1, wherein the at least one structurally robust arched plate diverges a nonlinear deformation created by the at least one applied load into a dispersed area, the dispersed area being greater than the at least one applied load area.

5. The apparatus according to claim 1, wherein the at least one applied load causes the at least one first arch to deform the first layer and the at least one second arch to deform the second layer.

6. The apparatus according to claim 1, wherein the at least one applied load is caused by at least one impact object or an energy flow.

7. The apparatus according to claim 6, wherein the at least one impact object is a projectile, shock wave, a blast, or forces imparted by a collision with at least one independent body.

8. The apparatus according to claim 1, wherein the object being protected is disposed underneath the at least one cell.

9. The apparatus according to claim 1, wherein the at least one cell further comprises a composite filler disposed inside a void defined by a space between the first and second arches of the at least one structurally robust arched plate.

10. The apparatus according to claim 1, wherein the object being protected by the apparatus is surrounded by the at least one cell.

11. The apparatus according to claim 10, wherein the apparatus forms at least one protective layer for the object being protected by the apparatus, and wherein the object is a vehicle, a protective deck, a wearing deck, a wall, a container, a door, or a person.

12. The apparatus according to claim 1, wherein the at least one structurally robust arched plate further comprises a segment disposed between and integral to the first and second arches, wherein the segment is configured to mechanically connect the first arch and the second arch to each other.

13. The apparatus according to claim 1, wherein the at least one cell further comprises a second structurally robust arched plate operatively connected to and disposed between the first and second layers configured to disperse energy created by the at least one applied load;

wherein the second structurally robust arched plate is defined by at least one first arch and at least one second arch;

wherein the second structurally robust arched plate is oriented parallel with the at least one structurally robust arched plate;

wherein the at least one first arch of the at least one structurally robust arched plate corresponds to the at least one second arch of the second structurally robust arched plate; and wherein the at least one second arch of the at least one structurally robust arched plate corresponds to the at least one first arch of the second structurally robust arched plate.

14. The apparatus according to claim 13, wherein the at least one cell further comprises a third structurally robust arched plate operatively connected to and disposed between the first and second layers configured to disperse energy created by the at least one applied load;

wherein the third structurally robust arched plate is defined by at least one first arch and at least one second arch; and wherein the third arched structurally robust plate is oriented perpendicular to the at least one structurally robust arched plate.

15. The apparatus according to claim 14, wherein the at least one cell further comprises a fourth structurally robust arched plate operatively connected to and disposed between the first and second layers configured to disperse energy created by the at least one applied load;

wherein the fourth structurally robust arched plate is defined by at least one first arch and at least one second arch;

wherein the fourth structurally robust arched plate is oriented parallel to the third structurally robust arched plate;

wherein the at least one first arch of the fourth structurally robust arched plate corresponds to the at least one second arch of the third structurally robust arched plate; and wherein the at least one second arch corresponds to the at least one first arch of the third structurally robust arched plate.

16. The apparatus according to claim 1, wherein a curvature and a size of that least one first arch is equal to or differs from a curvature and a size of the at least one second arch.

17. The apparatus according to claim 1, wherein the at least one cell further comprises:

a second structurally robust arched plate operatively connected and disposed underneath the second layer; and a third layer operatively connected and disposed underneath the second structurally robust arched plate, wherein the third layer comprises a third material;

wherein the second structurally robust arched plate is oriented parallel to the at least one structurally robust arched plate;

wherein the at least one applied load is transferred through that the at least one structurally robust arched plate causing a curvature and a size of the at least one first arch of the at least one structurally robust arched plate to deform causing the second layer to be conformed to the at least one structurally robust arched plate; and wherein energy created by the at least one applied load is diverged by the at least one structurally robust arched plate and the second layer.

18. The apparatus according to claim 1, wherein the at least one cell further comprises:

a second structurally robust arched plate operatively connected and disposed underneath the second layer; and a third layer operatively connected and disposed underneath the second structurally robust arched plate, wherein the third layer comprises a second material;

wherein the second structurally robust arched plate is oriented perpendicular to the at least one structurally robust arched plate;

wherein the at least one applied load is transferred through that least one structurally robust arched plate causing a curvature and a size of the at least one first arch of the at least one structurally robust arched plate to deform causing the second layer to be conformed to the at least one structurally robust arched plate; and wherein energy created by the at least one applied load is diverged by the at least one structurally robust arched plate and the second layer.

19. The apparatus according to claim 2, wherein the at least one first arch and at least one second arch form at least one bell by completely rotating a panel defined by a curve between a first position of the at least one first arch operatively connected to the first layer and a second position of the at least one second arch operatively connected to the second layer.

20. The apparatus according to claim 19, wherein the at least one applied load causes the at least one bell to deform the first layer at the first position and the at least one second layer at the second position; and wherein the at least one bell of the at least one structurally robust arched plate diverges a nonlinear deformation created by the at least one applied load into a dispersed area, the dispersed area being greater than the at least one applied load area.

21. The apparatus according to claim 1, wherein the first and second materials differ in one or more of material hardness, yield strength, fracture toughness, or Poisson's ratio.

* * * * *